US006109348A

United States Patent [19]

Caraway

[11] Patent Number: 6,109,348

[45] Date of Patent: Aug. 29, 2000

[54] ROTATING BLOWOUT PREVENTER

[76] Inventor: Miles F. Caraway, 3900 Roy Rd., Apt. 55, Shreveport, La. 71104

[21] Appl. No.: 08/914,933

[22] Filed: Aug. 20, 1997

Related U.S. Application Data

[60] Provisional application No. 60/024,304, Aug. 23, 1996.

[51] Int. Cl.[7] ..... E21B 33/03

[52] U.S. Cl. ..... 166/84.3; 175/195; 251/1.1; 277/324

[58] Field of Search ..... 175/195; 166/84.3, 166/84.4, 85.4; 251/1.1, 1.2; 277/326, 324

[56] References Cited

U.S. PATENT DOCUMENTS

| | | | |
|---|---|---|---|
| 2,243,439 | 5/1941 | Pranger et al. | 175/195 X |
| 2,333,847 | 11/1943 | Deely | 175/195 X |
| 3,128,614 | 4/1964 | Auer . | |
| 3,724,862 | 4/1973 | Biffle | 166/84.3 |
| 3,868,832 | 3/1975 | Biffle . | |
| 3,965,987 | 6/1976 | Biffle . | |
| 4,157,186 | 6/1979 | Murray et al. . | |
| 4,304,310 | 12/1981 | Garrett . | |
| 4,312,404 | 1/1982 | Morrow . | |
| 4,363,357 | 12/1982 | Hunter . | |
| 4,383,577 | 5/1983 | Pruitt . | |
| 4,398,599 | 8/1983 | Murray . | |
| 4,406,333 | 9/1983 | Adams . | |
| 4,416,340 | 11/1983 | Bailey . | |
| 4,423,776 | 1/1984 | Wagoner et al. . | |
| 4,428,592 | 1/1984 | Shaffer | 277/325 |
| 4,441,551 | 4/1984 | Bliffle | 166/84 |
| 4,448,255 | 5/1984 | Shaffer et al. . | |
| 4,529,210 | 7/1985 | Biffle | 277/31 |
| 4,531,580 | 7/1985 | Jones . | |
| 4,531,591 | 7/1985 | Johnston . | |
| 4,745,970 | 5/1988 | Bearden et al. . | |
| 4,783,084 | 11/1988 | Biffle . | |
| 5,022,472 | 6/1991 | Bailey et al. . | |
| 5,279,365 | 1/1994 | Yenuus et al. . | |
| 5,588,491 | 12/1996 | Brugman et al. | 166/383 |

*Primary Examiner*—Eileen D. Lillis
*Assistant Examiner*—Sunil Singh
*Attorney, Agent, or Firm*—Joan M Harrison

[57] ABSTRACT

A rotating blowout preventor having a spring-steel reinforced stripper rubber removably mounted in a rotating inner housing, wherein the stripper rubber is sealed against the drill pipe by well bore pressure and externally-applied hydraulic pressure. In a preferred embodiment the externally-applied hydraulic pressure is maintained against the middle and upper portion of the stripper rubber by using a pump at a level of about ten percent above the well bore pressure to insure rotation of the stripper rubber with the drilling string and minimize rotation of the drill pipe inside the stripper rubber. A bayonet-type locking mechanism is attached to the stripper rubber for selectively removing the stripper rubber from the rotating inner housing and changing or repairing the stripper rubber.

13 Claims, 3 Drawing Sheets

ROTATING BLOWOUT PREVENTER

CROSS-REFERENCE TO RELATED PATENT APPLICATIONS

This application claims the benefit of earlier field U.S. Provisional Patent Application Ser. No. 60/024,304, filed Aug. 23, 1996.

BACKGROUND OF THE INVENTION

1. Field of the Invention

This invention relates to blowout preventors for oil and gas wells and more particularly, to a rotating blowout preventor mounted on the well head or on one of the primary blowout preventors bolted to the well head, to pressure seal the interior of the well casing and permit forced circulation of drilling fluid through the well during the drilling operation. The rotating blowout preventor of this invention includes an outer housing attached to the well head or to one of the primary blowout preventors and an inner housing which is journalled for rotation in the outer housing and encloses a stripper rubber. The stripper rubber is designed to seal against a drill pipe in the drilling string by means of well bore pressure and hydraulic pressure maintained on the upper and middle portions of the stripper rubber by means of a hydraulic pump. In a preferred embodiment the hydraulic pressure applied to the stripper rubber is maintained above, and most preferably, about ten percent above the well bore pressure at all times and the well bore pressure is manually or automatically monitored to insure an excess of external hydraulic pressure appllied to the upper portion of the stripper rubber. In a preferred embodiment a J-tool device is attached to the stripper rubber for receiving a pipe clamp attached to a drill pipe in the drilling string and lifting the stripper rubber from the inner housing when it is desired to remove the stripper rubber from the rotating blowout preventor. Release of a bayonet coupling in the J-tool and stripper rubber top retaining plate facilitates removal and repair or replacement of the stripper rubber without the necessity of removing the inner housing of the rotating blowout preventor from the outer housing or the rotating blowout preventor from the well.

Oil, gas, and other wells are typically drilled with the drill bit connected to a hollow drilling string which is inserted into a well casing cemented in the well bore. A drilling head is attached to the well casing, well head or associated blowout preventor equipment for the purpose of sealing the interior of the well casing from the surface and facilitating forced circulation of drilling fluid through the well while drilling in the well. In the more commonly used forward circulation drilling technique, drilling fluid is pumped downwardly through the bore of the hollow drill string, out of the bottom of the bore and then upwardly through the annulus defined by the drill string and the interior of the well casing and subsequently from the well string side outlet at the housing. In reverse circulation, the drilling fluid is pumped directly through the side outlet or mud return and the annulus between the drill string and the well casing and subsequently upwardly through the drill string bore from the well.

Prior art drilling heads typically include a stationary body which carries a rotatable spindle operated by a kelly apparatus. One or more seals or packing elements, sometimes referred to as stripper packers or stripper rubbers, is carried by the spindle to seal the periphery of the kelly or the drive tube or sections of the drill pipe, whichever may be passing through the spindle, and thus confine the fluid pressure in the well casing to prevent the drilling fluid from escaping between the rotating spindle and the drilling string. As modern wells are drilled to ever deeper depths, greater temperatures and pressures are encountered, thus sometimes causing steam or hot water vapor at the drilling head. These rigorous drilling conditions pose increased risks to rig personnel from accidental scalding, burns or contamination by steam, hot water and hot caustic well fluids.

2. Description of the Prior Art

Among the patents which relate to rotating blowout preventors are the following: U.S. Pat. No. 3,128,614, dated Apr. 14, 1964 to Auer; U.S. Pat. No. 3,868,832, dated Mar. 4, 1975, to Biffle; U.S. Pat. No. 3,965,987, dated Jun. 29, 1976, to Biffle; U.S. Pat. No. 4,157,186, dated Jun. 5, 1979 to Murray, et al; U.S. Pat. No. 4,304,310, dated Dec. 8, 1981 to Garrett; U.S. Pat. No. 4,312,404, dated Jan. 26, 1982 to Morrow; U.S. Pat. No. 4,363,357, dated Dec. 14, 1982, to Hunter; U.S. Pat. No. 4,383,577, dated May 17, 1983, to Pruitt; U.S. Pat. No. 4,398,599, dated Aug. 16, 1983, to Murray; U.S. Pat. No. 4,406,333, dated Sep. 27, 1983, to Adams; U.S. Pat. No. 4,416,340, dated Nov. 22, 1983 to Bailey; U.S. Pat. No. 4,423,776, dated Jan. 3, 1984, to Wagoner et al; U.S. Pat. No. 4,783,084, dated Nov. 8, 1988 to Biffle; U.S. Pat. No. 4,448,255, dated May 15, 1984, to Shaffer et al; U.S. Pat. No. 4,531,580, dated Jul. 30, 1985 to Jones; U.S. Pat. No. 4,531,591, dated Jul. 30, 1985 to Johnston; U.S. Pat. No. 4,745,970, dated May 24, 1988 to Bearden et al; U.S. Pat. No. 5,022,472, dated Jun. 11, 1991 to Bailey, et al; and U.S. Pat. No. 5,279,365, dated Jan. 18, 1994 to Yenulis et al.

It is an object of this invention to provide a rotating blowout preventor which is characterized by a blowout preventor outer housing, an inner housing journalled for rotation inside the outer housing, a stripper rubber removably seated in the inner housing for rotating with the inner housing and the drilling string in the well, and a hydraulic pressurizing system communicating with the inner housing and stripper rubber for maintaining a selected level of hydraulic pressure on the stripper rubber and causing the stripper rubber to tightly seat against a drill pipe in the drilling string.

Another object of this invention is to provide a new and improved rotating blowout preventor for mounting on the well head or on one or more primary blowout preventors mounted on the well head, which rotating blowout preventor is characterized by a stripper rubber removably contained inside a rotating inner housing designed to rotate with respect to an outer housing; a brake for arresting rotation of the inner housing and stripper rubber; and a stripper rubber-removing tool attached to the top of the stripper rubber by means of a bayonet coupling and fitted with a J-slot for receiving a drill pipe clamp attached to the drill string and removing the stripper rubber from the inner housing at selected maintenance or replacement intervals.

A still further object of this invention is to provide a new and improved rotating blowout preventor for oil and gas wells, which device is characterized by an outer housing adapted for bolting to the well head or to one of a pair of primary blowout preventors mounted on the well head, an inner housing journalled for rotation in the outer housing and a reinforced stripper rubber removably attached to the inner housing, along with a hydraulic brake for arresting rotation of the inner housing and stripper rubber and a pump and sensing system for sensing the well bore pressure applied to the lower portion of the stripper rubber when the rotating blowout preventor is deployed in the well and pumping hydraulic fluid through the outer housing and inner housing against the middle and upper portions of the stripper rubber to maintain hydraulic pressure on these areas of the stripper rubber in excess of the well bore pressure applied to the lower portion of the stripper rubber.

Yet another object of this invention is to provide a technique for maintaining the stripper rubber of a rotating blowout preventor tightly in contact with the rotating drilling string and minimize rotation of the drilling string with respect to the stripper rubber, which technique includes the steps of removably mounting a pleated reinforced stripper rubber inside a rotating inner housing encircling a drill pipe, wherein the inner housing is journalled for rotation inside an outer housing; providing a brake for selectively arresting rotation of the inner housing and stripper rubber; providing a hydraulic pressurizing system communicating with the middle and upper portion of the stripper rubber for pressurizing the upper and middle portion of the stripper rubber and maintaining the stripper rubber tightly in contact with the drill pipe at a pressure above the well bore pressure operating on the bottom segment of the stripper rubber; and providing a lifting tool attached to the stripper rubber and a clamp for attachment to the drill pipe and lifting tool for selectively removing the stripper rubber from the inner housing by lifting the drilling string.

SUMMARY OF THE INVENTION

These and other objects of the invention are provided in a new and improved rotating blowout preventor which is characterized in a preferred embodiment by an outer housing adapted for bolting directly to the well head or on a primary blowout preventor attached to the well head; an inner housing rotatably disposed by means of ball bearings within the outer housing; a stripper rubber fitted with a pleated metal reinforcement removably attached to the inner housing and removable from the inner housing by means of a J-tool and bayonet coupling, such that the stripper rubber normally rotates with the inner housing inside the outer housing pursuant to rotation of a drilling string extending through the stripper rubber; a hydraulic brake mounted on the outer housing and extending to the inner housing for registering with slots in the inner housing and selectively arresting rotation of the inner housing and the stripper rubber; a hydraulic pressure system communicating with the middle and upper portion of the stripper rubber and a sensing apparatus in the hydraulic pressure system communicating with the well bore and the lower portion of the stripper rubber, wherein hydraulic pressure is maintained on the middle and upper portions of the stripper rubber above application of the well bore pressure on the lower portion of the stripper rubber, to facilitate secure engagement by the stripper rubber of the drill pipe extending through the stripper rubber and preventing blowout of the well. In a preferred embodiment a pipe clamp is fitted with outwardly-extending pins for engaging a J-slot in a J-tool clamped to the drill pipe extending through the stripper rubber and unlocking the stripper rubber from the inner housing to remove and repair or replace the stripper rubber without the necessity of pulling the drilling string from the well or removing the blowout preventor from the well bore.

BRIEF DESCRIPTION OF THE DRAWINGS

The invention will be better understood by reference to the accompanying drawings, wherein.

DESCRIPTION OF THE PREFERRED EMBODIMENTS

Figure 1:
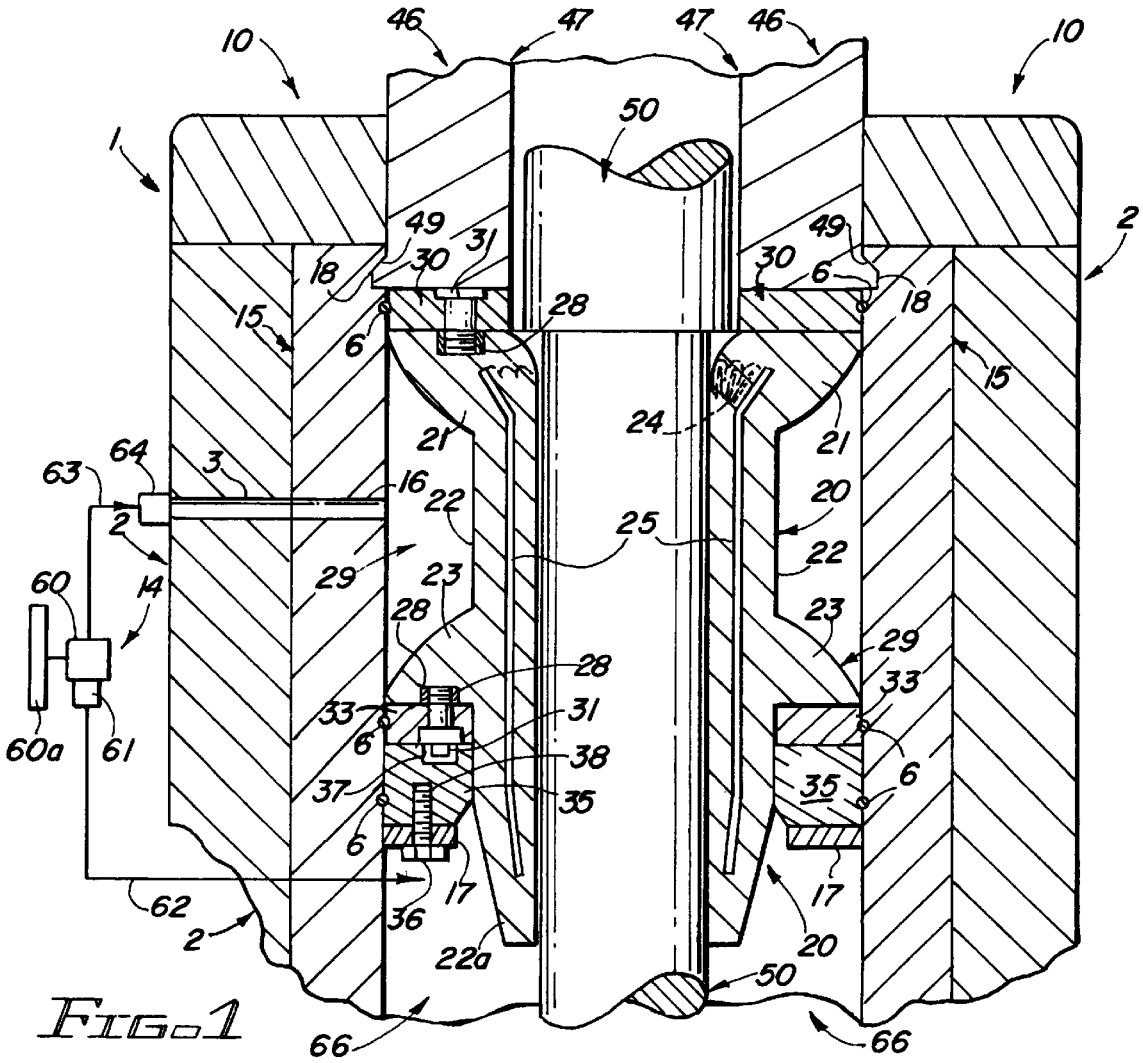
FIG. 1 is a sectional view of a preferred embodiment of the rotating blowout preventor of this invention.
Figure 2:
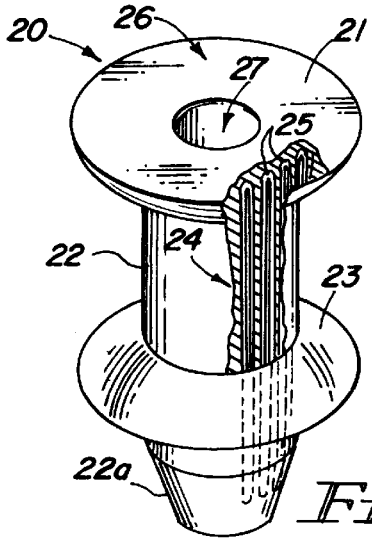
FIG. 2 is a perspective view of a preferred steel-reinforced stripper rubber for operation in the rotating blowout preventor illustrated in FIG. 1.
Figure 3:
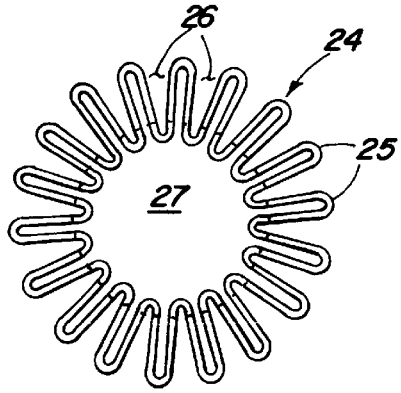
FIG. 3 is a top sectional view of the pleated steel reinforcement provided in the stripper rubber illustrated in FIG. 2.
Figure 7:
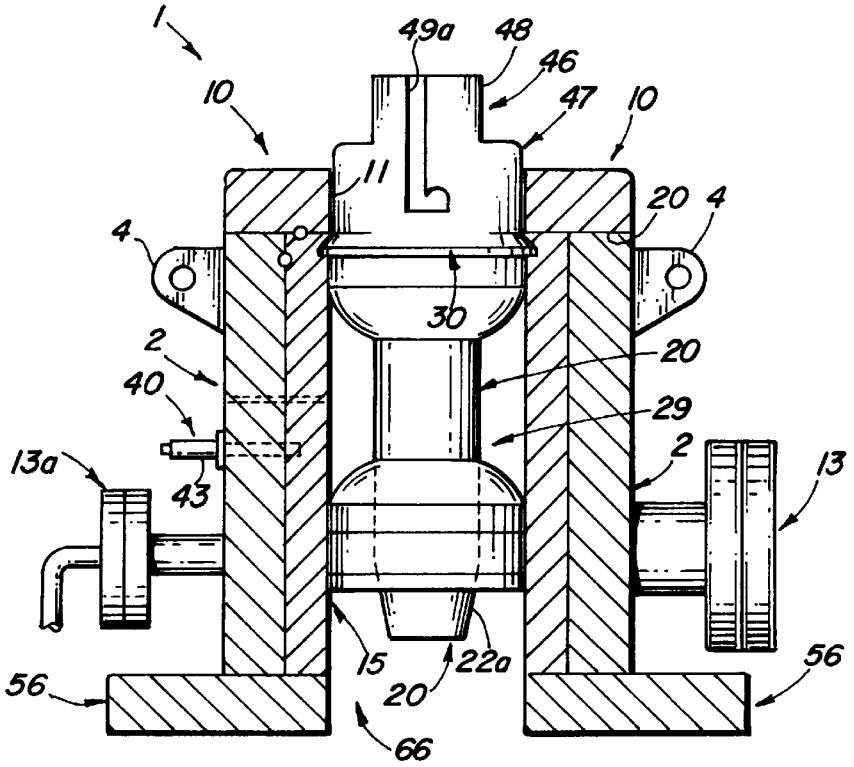
FIG. 7 is a sectional view of the J-tool, stripper rubber, inner housing and outer housing illustrated in FIG. 1.
Figure 9:
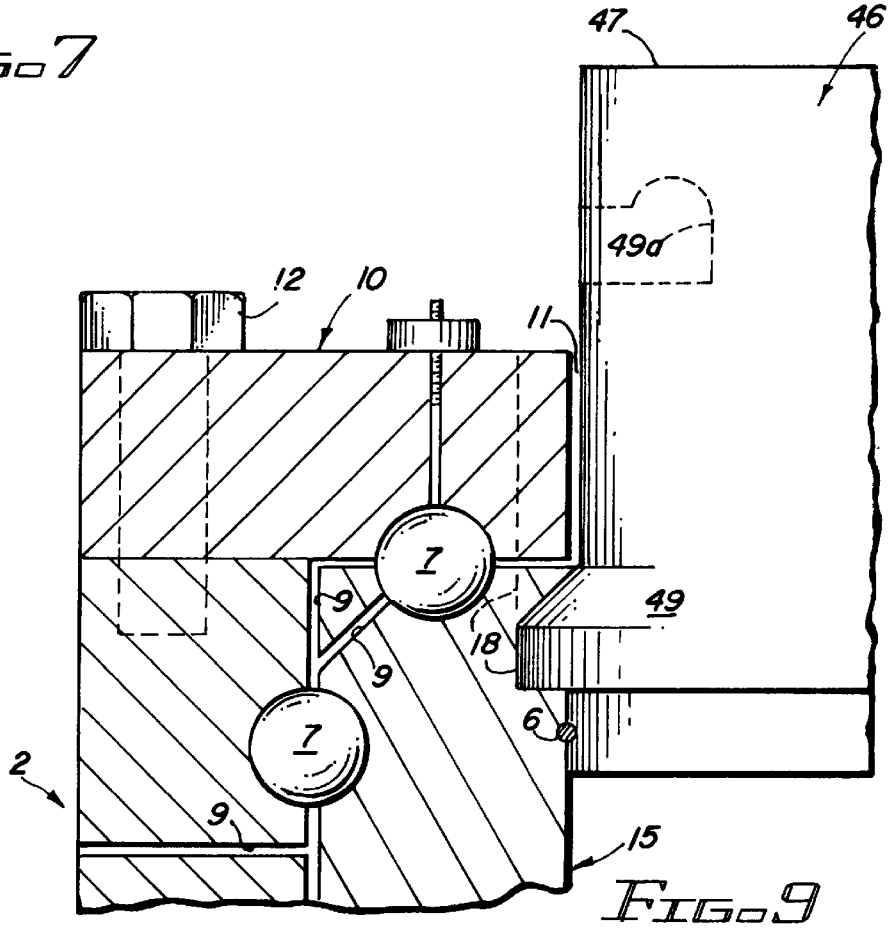
FIG. 9 is an enlarged sectional view of the upper portion of the rotating blowout preventor illustrated in FIGS. 1 and 4, more particularly illustrating a preferred lubrication system for lubricating the ball bearings which mount the upper end of the inner housing in the outer housing.

Referring initially to FIGS. 1–4, 7 and 9 of the drawings, the rotating blowout preventor of this invention is generally illustrated by reference numeral 1. The rotating blowout preventor 1 includes an outer housing 2, which may be typically bolted by means of a mount flange 56 to the well head or to a primary blowout preventor or preventors bolted to the well head (not illustrated) to pressure-seal the interior of a well casing and allow circulation of drilling fluid through the well during drilling operations. The outer housing 2 typically has a conventional mud return 13 and choke line 13*a*, as well as lifting lugs 4, as illustrated in FIG. 7, and is fitted with a pressure inlet 3 and a hydraulic pressure system 14. The hydraulic pressure system 14 includes a hydraulic pump 60, served by a hydraulic fluid reservoir 60*a* and designed to pump hydraulic fluid into the pressure inlet 3 through a pump discharge line 63, as illustrated in FIG. 1. A sensor line 62 extends from a pressure sensor 61 located on the hydraulic pump 60 into the well bore 66, in order to continually monitor the pressure in the well bore 66 for purposes which will be hereinafter further described. Multiple ball bearings 7 are seated in corresponding bearing seats 7*a* in the outer housing 2 by means of cooperating bearing stays 7*b*, as further illustrated in FIG. 4 of the drawings. In each case, a bearing spring 8 is disposed in the corresponding bearing seat 7*a* and maintains pressure against the bearing stay 7*b* to force each corresponding ball bearing 7 firmly into the seated position in the outer housing 2, as well as in a corresponding seat provided in the inner housing 15, which is rotatably disposed with respect to the outer housing 2. In a preferred embodiment of the invention a grease fitting 8*b* is threaded into each of the bearing seats 7*a* for lubricating the corresponding ball bearing 7 and the bearing springs 8*b*, respectively. As illustrated in FIG. 9, the ball bearings 7 are typically lubricated by oil-mist lubrication, wherein the lubricating mist is forced into the bearing lube channels 9 at the cap 10 and exits at the outer housing 2. Accordingly, as further illustrated in FIG. 4, the inner housing 15 is sealed by high pressure rotary seals 58 in a rotatable configuration inside the outer housing 2 by means of the ball bearings 7 and a stripper rubber 20 is positioned inside the inner housing 15 and is secured in place by means of a top retaining plate 30, bottom retaining plate 33 and a retaining ring 35 at the plate seals 6, as illustrated in FIGS. 1 and 5. The plate seals 6 are typically O-rings. The top retaining plate 30 is secured in position inside the inner housing 15 by means of a set of retaining plate bolts 31, extending in spaced relationship around the top retaining plate 30 and threadably seated in corresponding threaded rings 28, embedded in the top flute 21 of the stripper rubber 20, as illustrated in FIG. 1. Similarly, a bottom retaining plate 33 is removably secured to the bottom flute 23 of the stripper rubber 20 by means of corresponding retaining bolts 31. The entire stripper rubber 20, top retaining plate 30 and bottom retaining plate 33 assembly is maintained in position inside the inner housing 15 by means of a retaining ring 35. The retaining ring 35 is secured to the stripper rubber 20 by means of the retaining plate bolts 31, extending through retaining ring bolt slots 37 in the retaining ring 35 and threaded into the corresponding threaded rings 28, embedded in the stripper rubber 20. The retaining ring 35 is also secured to an inner housing flange 17 extending inwardly from the inner housing 15, by means of retaining ring bolts 36, which thread into the retaining ring bolt slots 37. Accordingly, removal of the retaining ring bolts 36 from the inner housing flange 17 and the respective retaining plate bolt slots 38 in the retaining ring 35 allows the stripper rubber 20, along with the respective top retaining plate 30, bottom retaining plate 33 and the retaining ring 35 to be remove from the inner housing 15, as hereinafter further described.

In a most preferred embodiment of the invention and referring again to FIGS. 1–3 of the drawings, an expandable, pleated steel reinforcement 24 is provided in the molded stripper rubber 20 and includes reinforcing pleats 25, spaced by pleat spaces 26, surrounding a stripper rubber bore 27 in the stripper rubber 20, which stripper bore 27 receives the drill pipe 50, as illustrated in FIG. 1. Accordingly, the expandable reinforcement 24 serves to reinforce the stripper rubber 20 under various conditions of pressure which is applied to the stripper rubber 20, as hereinafter further described.

Referring again to FIG. 1 of the drawings, in a most preferred embodiment of the invention the hydraulic pressure system 14 serves to maintain a selected hydraulic pressure in the stripper rubber annulus 29, defined by the inner housing 15 and the top flute 21, neck 22 and bottom flute 23 of the stripper rubber 20, as further illustrated in FIG. 1. Access to the stripper rubber annulus 29 is provided by means of multiple, spaced inner housing openings 16, radially provided in the inner housing 15, which inner housing openings 16 sequentially communicate with the fixed pressure inlet 3 provided in the outer housing 2, as further illustrated in FIG. 1. Accordingly, as the inner housing 15 and stripper rubber 20 rotate inside the outer housing 2, the inner housing openings 16 sequentially register with the pressure inlet 3 provided in the outer housing 2 to facilitate a flow of hydraulic fluid from the hydraulic pump 60 through the pump discharge line 63 and through a fitting 64, into the pressure inlet 3. Consequently, a desired pressure can be automatically or manually maintained in the stripper rubber annulus 29 against the stripper rubber 20 by operation of the hydraulic pump 60, as further hereinafter described.

Referring now to FIGS. 1, 6 and 7–10 of the drawings, the stripper rubber 20 is easily removed from the interior of the inner housing 15 by operation of a J-tool 46, having a J-tool insert locking cap 47 mounted on the top flute 21 of the stripper rubber 20 by means of the top retaining plate 30 and the retaining plate bolts 31, as heretofore described. The J-tool insert locking cap 47 includes an insert riser 48, provided with lubricating mist is forced into the bearing lube channels 9 at the cap 10 and exits at the outer housing 2. Accordingly, as further illustrated in FIG. 4, the inner housing 15 is sealed by high pressure rotary seals 58 in a rotatable configuration inside the outer housing 2 by means of the ball bearings 7 and a stripper rubber 20 is positioned inside the inner housing 15 and is secured in place by means of a top retaining plate 30, bottom retaining plate 33 and a retaining ring 35 at the plate seals 6, as illustrated in FIGS. 1 and 5. The plate seals 6 are typically O-rings. The top retaining plate 30 is secured in position inside the inner housing 15 by means of a set of retaining plate bolts 31, extending in spaced relationship around the top retaining plate 30 and threadably seated in corresponding threaded rings 28, embedded in the top flute 21 of the stripper rubber 20, as illustrated in FIG. 1. Similarly, a bottom retaining plate 33 is removably secured to the bottom flute 23 of the stripper rubber 20 by means of corresponding retaining bolts 31. The entire stripper rubber 20, top retaining plate 30 and bottom retaining plate 33 assembly is maintained in position inside the inner housing 15 by means of a retaining ring 35. The retaining ring 35 is secured to the stripper rubber 20 by means of the retaining plate bolts 31, extending through retaining ring bolt slots 37 in the retaining ring 35 and threaded into the corresponding threaded rings 28, embedded in the stripper rubber 20. The retaining ring 35 is also secured to an inner housing flange 17 extending inwardly from the inner housing 15, by means of retaining ring bolts 36, which thread into the retaining ring bolt slots 37. Accordingly, removal of the retaining ring bolts 36 from the inner housing flange 17 and the respective retaining plate bolt slots 38 in the retaining ring 35 allows the stripper rubber 20, along with the respective top retaining plate 30, bottom retaining plate 33 and the retaining ring 35 to be removed from the inner housing 15, as hereinafter further described.

In a most preferred embodiment of the invention and referring again to FIGS. 1–3 of the drawings, an expandable, insert lugs 49, normally seated in corresponding lug slots 18, provided in the inner housing 15 and the cap 10 and the J-tool insert locking cap 47 is fitted with a J-slot 49*a*, as further illustrated in FIGS. 7 and 9 of the drawings. The J-slot 49*a* is designed to receive a pair of outwardly-extending jaw pins 54, extending from the clamp jaws 52 of a pipe clamp 51 having jaw teeth 53, as further illustrated in FIG. 8. Accordingly, when the pipe clamp 51 is positioned to clamp on the drill pipe 50 with the jaw pins 54 extending into the J-slot 49*a*, the stripper rubber 20 can be removed from the inner housing 15 after removal of the corresponding retaining ring bolts 36 from the retaining ring 35 and the inner housing flange 17, as hereinafter further described.

Referring again to FIGS. 7 and 9 of the drawings, the outer housing 2 is closed by a cap 10 having a cap opening 11 to accommodate the J-tool 46. The cap bolts 12 extend through the cap 10 and threadably engage the outer housing 2 to removably secure the cap 10 on the outer housing 2.

Figure 4:
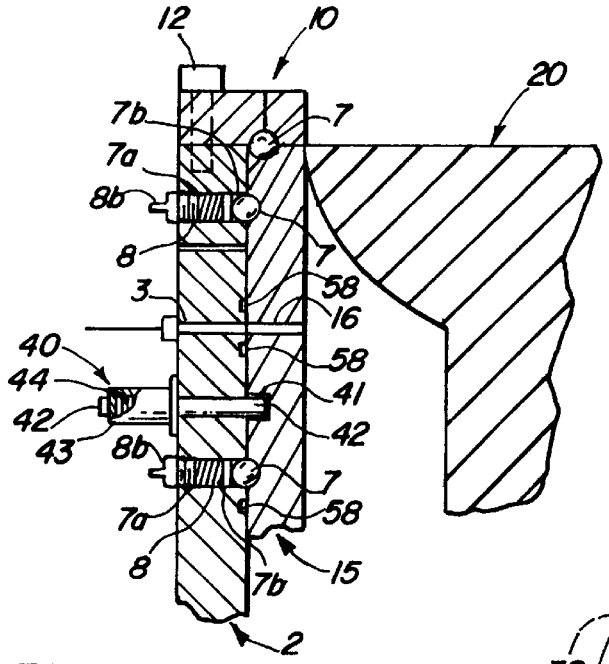
FIG. 4 is a sectional view of the upper portion of the rotating blowout preventor illustrated in FIG. 1, more particularly illustrating ball bearings positioned for effecting rotation of the inner housing with respect to the outer housing.
Figure 5:
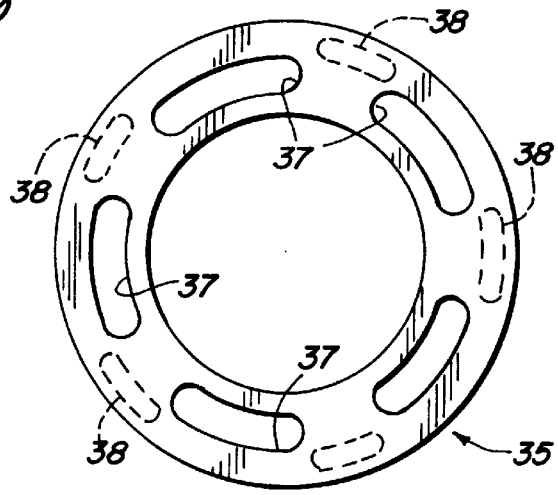
FIG. 5 is a top view of a typical retaining ring for mounting the stripper rubber assembly in the inner housing of the rotating blowout preventor illustrated in FIG. 1.
Figure 8:
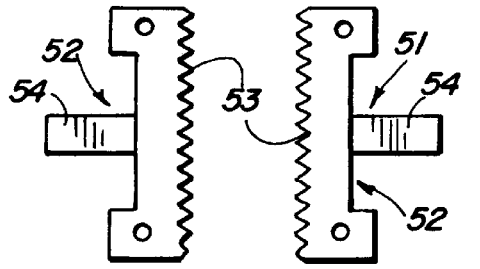
FIG. 8 is a side view of a typical pipe clamp assembly for clamping onto the drill pipe extending through the stripper rubber, engaging the J-tool slot of the J-tool illustrated in FIG. 7 and selectively removing the stripper rubber from the rotating blowout preventor illustrated in FIG. 1.
Figure 6:
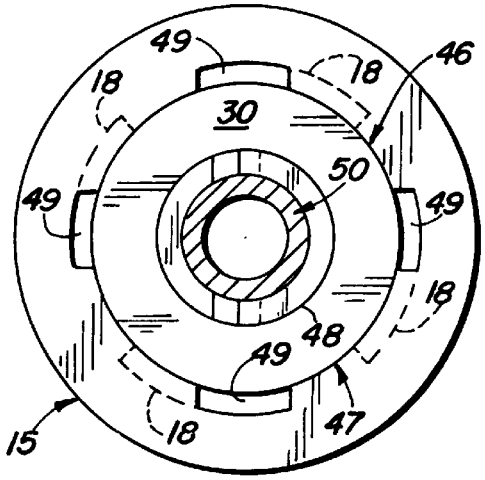
FIG. 6 is a top view of a typical J-tool having an insert locking cap for removable attachment to the inner housing and stripper rubber and removably mounting the stripper rubber in the rotating blowout preventor illustrated in FIG. 1.
Figure 10:
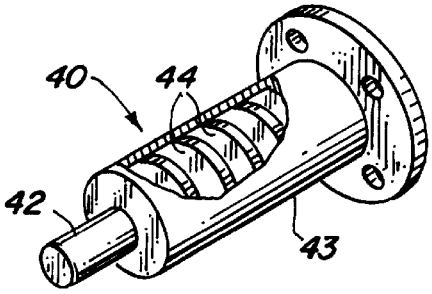
FIG. 10 is a perspective view of a hydraulic brake mounted on the outer housing of the rotating blowout preventor illustrated in FIGS. 4 and 7 for selectively arresting rotation of the inner housing and stripper rubber.

Referring now to FIGS. 4, 7 and 10 of the drawings, a hydraulic brake 40 is mounted on the outer housing 2 and includes a bar flange 43, which is mounted on the outer housing 2 and encloses multiple bellville washers 44 and an engaging bar 42, which extends through the bellville washers 44 and engages the outside end one of the bellville washers 44 inside the bar housing 43. The operating end of the engaging bar 42 projects through the outer housing 2 and selectively into one of several radially-disposed, peripheral brake slots 41 provided in the inner housing 15, as illustrated in FIG. 4. A hydraulic mechanism (not illustrated) is provided in association with the opposite end of the engaging bar 42 to selectively apply pressure on the engaging bar 42 and force the operating end of the engaging bar 42 into the brake slot 41 in the inner housing 15 against the bias of the bellville washers 44 to prevent rotation of the inner housing 15 and the stripper rubber 20 within the outer housing 2. Upon release of hydraulic pressure from the engaging bar 42, the bellville washers 44 assume their original configuration and force the engaging bar 42 outwardly, thereby disengaging the operating end of the engaging bar 42 from one of the brake slots 41 provided in the inner housing 15 and allowing the drilling string, inner housing 15 and the stripper rubber 20 to again rotate with respect to the outer housing 2.

In operation, the rotating blowout preventor 1 of this invention is typically used in association with one or more additional blowout preventors to seal a well during a drilling operation as follows: The rotating blowout preventor 1 receives a drill pipe 50 of a drilling string which extends through the stripper rubber 20 of the rotating blowout preventor 1 as the well is drilled. The stripper rubber 20 is typically secured tightly to the drill pipe 50 by means of well bore pressure in the well bore 66 and hydraulic pressure maintained in the stripper rubber annulus 29 on the neck 22 and top flute 21 of the stripper rubber 20, by operation of the hydraulic pump 60, responsive to the pressure sensor 61, which monitors the well bore pressure in the well bore 66. It is highly desirable to always maintain the stripper rubber 20 in tight contact with the drill pipe 50 in order to eliminate, or at least minimize, rotation of the drill pipe 50 and the drill string with respect to the stripper rubber 20, thereby causing undue wear on the stripper rubber 20. This ideal drilling circumstance is achieved by maintaining the hydraulic pressure in the stripper rubber annulus 29 above the pressure in the well bore 66 and most preferably, about ten percent above the well bore pressure exerted against the neck extension 22*a* of the stripper rubber 20 in the well bore 66. This disparity in hydraulic and well bore pressure is maintained by operation of the pressure sensor 61 and the hydraulic pump 60, which pressure sensor 61 constantly monitors the pressure in the well bore 66 and facilitates operation of the hydraulic pump 60 to maintain a higher pressure in the stripper rubber annulus 29 at all times. Hydraulic fluid for operation of the hydraulic pump 60 is stored in the hydraulic fluid reservoir 60*a* and appropriate instrumentation known to those skilled in the art may be utilized in order to connect the pressure sensor 61 to the hydraulic pump 60 and facilitate the appropriate monitoring of the well bore 66 pressure and operation of the hydraulic pump 60 to effect the desired pressure differential between the hydraulic fluid pressure in the stripper rubber annulus 29 and the pressure in the well bore 66.

Under circumstances where it is desired to remove and replace or repair the stripper rubber 20, the conventional blowout preventor or preventors upon which the rotating blowout preventor 1 is mounted are closed to insure that well bore pressure will not be exerted against the rotating blowout preventor 1 during the stripper rubber change-out operation. Under circumstances where there is no pressure on the well, this step is not necessary and the stripper rubber 20 can be changed without fear of pressure surge from the well. The hydraulic brake 40 is then operated to extend the operating end of the engaging bar 42 into a brake slot 41 in the inner housing 15 and terminate rotation of the inner housing 15, stripper rubber 20 and drill pipe 50. The drill pipe 50 is then loosely fitted with the pipe clamp 51. When the jaw pins 54 are secured in the J-slot 49*a* of the J-tool insert locking cap 47, the jaw teeth 53 of the clamp jaws 52 are tightly clamped on the drill pipe 50 and the entire drill string and the drill pipe 50 are rotated approximately one-quarter of a turn to disengage the insert lugs 49 of the J-tool insert locking cap 47 from the corresponding lug slots 18, provided in the inner housing 15, as further illustrated in FIGS. 1 and 6. The stripper rubber 20 can then be lifted with the J-tool 46 by lifting the drilling string and drill pipe 50, for repair or replacement. In this manner, the stripper rubber 20 can be quickly and easily replaced or repaired as necessary without the necessity of pulling the entire rotating blowout preventor 1, including the outer housing 2, from the well.

A primary advantage of the rotating blowout preventor 1 of this invention is the capacity for always maintaining a higher pressure on the neck 22 and the top flute 21 of the stripper rubber 20 than is applied against the neck extension 22*a* of the stripper rubber 20 by operation of the pressure in the well bore 66. In a most preferred embodiment of the invention this pressure differential is approximately ten percent greater in the stripper rubber annulus 29 than in the well bore 66. Accordingly, in another most preferred embodiment of the invention the pressure in the well bore 66 is monitored by means of the pressure sensor 61 and operation of the hydraulic pump 60 automatically maintains the desired pressure differential.

Referring again to FIGS. 1–3 of the drawings, it will be appreciated that application and adjustment of hydraulic pressure on the top flute 21 and neck 22 of the stripper rubber 20, as well as the pressure applied to the neck extension 22*a* in the well bore 66, greatly stresses the stripper rubber 20. The expandable pleated reinforcement 24 is designed to relieve this stress as the reinforcing pleats 25 expand and contract into and from the pleat spaces 26 as the pressure on the stripper rubber varies.

While the preferred embodiments of this invention have been described above, it will be recognized and understood that various modifications may be made in the invention and the appended claims are intended to cover all such modifications which may fall within the scope and spirit of the invention.

Having described my invention with the particularity set forth above, what is claimed is:

1. A rotating blowout preventor for a well containing a well head and drill pipe extending through the well head into the well, comprising an outer housing for attachment to the well head and having a housing opening; an inner housing journaled for rotation in said outer housing; a stripper rubber removably disposed in said inner housing around the drill pipe for rotation with said inner housing and the drill pipe; a pleated reinforcement provided in said stripper rubber for reinforcing said stripper rubber; a stripper rubber mount extending through said housing opening for carrying said stripper rubber, whereby said stripper rubber and said stripper rubber mount normally rotate with said inner housing and the drill pipe with respect to said outer housing and said stripper rubber is removable from said inner housing responsive to removal of said stripper rubber mount from the well; and a clamp engaging said stripper rubber mount and the drill pipe for lifting said stripper rubber mount from said outer housing and said stripper rubber from said inner housing responsive to raising of the drill pipe in the well.

2. The rotating blowout preventor of claim 1 comprising a pressure-inducing mechanism communicating with said inner housing for selectively applying pressure on said stripper rubber and sealing said stripper rubber against the drill pipe.

3. A rotating blowout preventor for a well containing a well head and drill pipe extending through the well head into the well, comprising an outer housing for attachment to the well head and having a housing opening; an inner housing journaled for rotation in said outer housing; a stripper rubber removably disposed in said inner housing around the drill pipe for rotation with said inner housing and the drill pipe; a pleated reinforcement provided in said stripper rubber for reinforcing said stripper rubber; a stripper rubber mount extending through said housing opening for carrying said stripper rubber, whereby said stripper rubber and said stripper rubber mount normally rotate with said inner housing and the drill pipe with respect to said outer housing and said stripper rubber is removable from said inner housing responsive to removal of said stripper rubber mount from the well; and an inner housing brake mounted on said outer housing and selectively engaging said inner housing for selectively terminating rotation of said inner housing, said stripper rubber and the drill pipe.

4. The rotating blowout preventor of claim 3 comprising a clamp engaging said stripper rubber mount and the drill pipe for lifting said stripper rubber mount from said outer housing and said stripper rubber from said inner housing responsive to raising of the drill pipe in the well.

5. The rotating blowout preventor of claim 3 comprising a pressure-inducing mechanism communicating with said inner housing for selectively applying pressure on said stripper rubber and sealing said stripper rubber against the drill pipe.

6. The rotating blowout preventor of claim 3 comprising:

(a) a clamp engaging said stripper rubber mount and the drill pipe for lifting said stripper rubber mount from said outer housing and said stripper rubber from said inner housing responsive to raising of the drill pipe in the well; and (b) a pressure-inducing mechanism communicating with said inner housing for selectively applying pressure on said stripper rubber and sealing said stripper rubber against the drill pipe.

7. A rotating blowout preventor for a well having a well head and a well bore with well bore pressure beneath the well head and a drilling string disposed through the well head in the well bore, said rotating blowout preventor comprising an outer housing for attachment to the well head and having a housing opening; an inner housing disposed for rotation within said outer housing; a stripper rubber disposed within said inner housing and exposed to the well bore pressure for rotation with said inner housing and the drilling string; a pleated reinforcement provided in said stripper rubber for reinforcing said stripper rubber against said well bore pressure; a stripper rubber mount extending through said housing opening and removably attached to said stripper rubber; a clamp engaging said stripper rubber mount for removing said stripper rubber from said outer housing through said housing opening responsive to lifting the drilling string in the well; and a pressure-inducing mechanism communicating with said inner housing for selectively applying pressure on said stripper rubber and sealing said stripper rubber against the drill pipe.

8. The rotating blowout preventor of claim 7 comprising an inner housing brake mounted on said outer housing for selectively engaging said inner housing, whereby rotation of the drilling string, said inner housing and said stripper rubber is selectively stopped responsive to operation of said inner housing brake.

9. The rotating blowout preventor of claim 8 wherein said pressure inducing mechanism comprises a hydraulic fluid pump communicating with said inner housing for pumping hydraulic fluid into said inner housing and a sensor provided in operative communication with said hydraulic fluid pump, said sensor communicating with the well bore for sensing the well bore pressure, whereby said hydraulic fluid pump operates to pump hydraulic fluid into said inner housing and maintain said hydraulic pressure above the well bore pressure responsive to sensing of the well bore pressure by said sensor.

10. A rotating blowout preventor for a well having a well head and a well bore subjected to well bore pressure beneath the well head and a drilling string extending through the well head into the well bore, said rotating blowout preventor comprising an outer housing for attachment to the well head and having a housing opening at the top of said outer housing; an inner housing disposed for rotation within said outer housing; a stripper rubber provided in said inner housing for receiving the drilling string and rotation with said inner housing and the drilling string, wherein at least a portion of said stripper rubber is subjected to the well bore pressure; a stripper rubber mount extending through said housing opening and removably attached to said stripper rubber; an inner housing brake mounted on said outer housing and selectively engaging said inner housing for terminating rotation of said inner housing, said stripper rubber and the drilling string; and a clamp selectively clamping on the drilling string and engaging said stripper rubber mount for removing said stripper rubber from said inner housing through said housing opening responsive to operation of said inner housing brake and lifting of the drilling string in the well.

11. The rotating blowout preventor of claim 10 comprising a hydraulic pressure inducing mechanism communicating with said inner housing for selectively applying hydraulic pressure on said stripper rubber and sealing said stripper rubber against the drilling string, whereby said hydraulic pressure is maintained above the well bore pressure.

12. The rotating blowout preventor of claim 11 wherein said hydraulic pressure is maintained about ten percent above said well bore pressure.

13. The rotating blowout preventor of claim 12 wherein said hydraulic inducing mechanism comprises a hydraulic fluid pump communicating with said inner housing for pumping hydraulic fluid into said inner housing and a sensor provided in operative communication with said hydraulic fluid pump, said sensor communicating with the well bore for sensing the well bore pressure, whereby said hydraulic fluid pump operates to pump hydraulic fluid into said inner housing and maintain said hydraulic pressure above the well bore pressure responsive to sensing of the well bore pressure by said sensor.

* * * * *